United States Patent [19]

Herzig

[11] 4,106,533

[45] Aug. 15, 1978

[54] APPARATUS FOR AND A METHOD OF INTRODUCING COMBUSTIBLE PARTICULATE MATERIAL INTO A PRESSURIZED GASIFYING VESSEL

[75] Inventor: Alfred Herzig, Essen, Del.X

[73] Assignee: Krupp-Koppers GmbH, Essen, Fed. Rep. of Germany

[21] Appl. No.: 749,712

[22] Filed: Dec. 8, 1976

[30] Foreign Application Priority Data

Dec. 13, 1975 [DE] Fed. Rep. of Germany ..... 2556162

[51] Int. Cl.[2] ..... B65B 1/16

[52] U.S. Cl. ..... 141/1; 141/67; 141/248; 222/373; 222/386.5; 222/450; 302/53

[58] Field of Search ..... 141/1, 4–6, 141/47, 67, 68, 234, 242, 243, 248, 392; 222/373, 386.5, 450; 302/53

[56] References Cited

U.S. PATENT DOCUMENTS

| | | | |
|---|---|---|---|
| 3,159,432 | 12/1964 | Ostrowski et al. | 302/53 |
| 3,187,401 | 6/1965 | O'Donnell et al. | 222/373 X |
| 3,568,733 | 3/1971 | Lau | 141/68 X |
| 3,788,368 | 1/1974 | Geng et al. | 222/373 X |

*Primary Examiner*—Richard E. Aegerter
*Assistant Examiner*—Frederick R. Schmidt
*Attorney, Agent, or Firm*—Michael J. Striker

[57] ABSTRACT

A continuously operating gasifying vessel is supplied with a combustible particulate material from a source of such material through two cyclically operating conveying tubes each of which has a diaphragm member in its interior. The diaphragm member subdivides the interior of each of the conveying tubes into a first compartment which communicates with the supply and with the vessel, and a second compartment which surrounds the first compartment. A first valve is interposed between the source and the first compartment, and a second valve is interposed between the first compartment and the vessel. When the first valve is opened and the second closed, material is introduced into the first compartment, and when the first valve is closed and the second valve is opened, the material is discharged into the vessel at an elevated pressure. To elevate the pressure in the first compartment, a pressurized fluid is introduced thereinto. Control fluid is admitted and withdrawn from the second compartment to contract and expand the diaphragm member and thus control the volume of the first compartment. The pressurized fluid used for pressurizing the contents of one of the first compartments is the fluid expelled from the other first compartment during the reduction of volume thereof.

18 Claims, 4 Drawing Figures

5
26
25
14
13
2
2a
12
11
8
9
7
10
1
1a
14
9
22
21
20
19
18
24
23
15
15a
16
17
3
3a
6

APPARATUS FOR AND A METHOD OF INTRODUCING COMBUSTIBLE PARTICULATE MATERIAL INTO A PRESSURIZED GASIFYING VESSEL

BACKGROUND OF THE INVENTION

The present invention relates to an arrangement for introducing a bulk material into a vessel, particularly a combustible particulate material into a pressurized gasifying vessel, and to a method of operating such an arrangement.

Attempts have already been made to gasify combustible particulate materials, the particulate sizes of which may range from small granules to dust-like consistency. In particular, it has been already attempted to so gasify, for instance, coaldust, which is otherwise a very difficult substance to burn by traditional methods. Such gasification is usually performed at high pressures, such as, for instance, 25 atm. above the atmospheric pressure and in the presence of oxygen or oxygen-containing gaseous media, whereby partial oxidation is achieved. When such considerable pressure is to be employed, the arrangement for introducing the particulate material into the gasifying vessel, such as a lock-type arrangement, must be so constructed and dimensioned as to be able to withstand such high pressures and pressure differentials, so that such arrangements are rather complex, expensive and prone to malfunction.

Experience has shown, however, that when the gaseous medium obtained during the partial oxidation is to be used immediately and/or in the immediate vicinity of the gasifying device, a situation may arise in which a relatively low pressure is needed in the gasifying space in order to obtain a gas which can be used to advantage. Various computations have been made in this connection with the result that it is sufficient, under such circumstances, to operate the gasifying arrangement at a pressure of 5 atm. superatmospheric pressure maximum, at which pressure the gaseous medium will also be discharged from the gasifying space.

SUMMARY OF THE INVENTION

Accordingly, it is a general object of the present invention to avoid the disadvantages of the prior-art high-pressure gasifying arrangements.

More particularly, it is an object of the present invention to devise an arrangement for introducing combustible particulate material into such gasifying vessels which operate at the above-mentioned rather low superatmospheric pressure. It is a further object of the present invention to provide an arrangement of this type which is simple in construction, reliable in operation and inexpensive to manufacture.

A concomitant object of the present invention is to devise a method of introducing such combustible particulate material into the gasifying vessel.

It is still another object of the present invention to present a method of operating the above-mentioned arrangement.

In pursuance of these objects and others which will become apparent hereafter, one feature of the present invention resides, briefly stated, in an arrangement for introducing bulk material into a vessel, particularly combustible particulate material into a pressurized gasifying vessel, which comprises a supply of material; at least one conveying tube extending between the supply and the vessel; at least one flexible diaphragm member extending longitudinally of the conveying tube in the interior thereof and subdividing the latter into a first compartment communicating with the source and with the vessel and a second compartment situated between the diaphragm member and the conveying tube and surrounding the first compartment; first valve means interposed between the source and the first compartment and operative for admitting the material into the latter; second valve means interposed between the first compartment and the vessel and operative for discharging the material from the former into the latter; and means for admitting a control medium into the second compartment to contract and expand the diaphragm member to thereby control the volume of the first compartment. The arrangement, as currently preferred, further comprises means for introducing a pressurized fluid into the first compartment upon the closing of the first valve means and at least prior to the opening of the second valve means to thereby equalize the pressure in the first compartment with that in the vessel. The introducing means may also be operative after opening of the second valve means to enhance the discharge of the material from the first compartment into the vessel.

In a currently preferred embodiment of the present invention, two of the above-discussed units are arranged side-by-side, the two units being alternatingly filled with and emptied of the material. A conduit may communicate the first compartments of the two units with one another, and third valve means may be interposed in the conduit means and operative for establishing communication between an empty first compartment and a full first compartment so that, upon contraction of the diaphragm member bounding the empty first compartment, the pressurized fluid flows through the conduit into the full first compartment. Instead of, or in addition to, the above-mentioned communication of the two first compartments, the introducing means may include a source of the pressurized fluid, duct means communicating the source with the first compartments, and additional valve means interposed in the duct means and operative for alternatingly establishing communication between the source and the selected one of the first compartments. Preferably, the pressurized fluid is nitrogen.

The diaphragm member may have a tubular configuration and may be coaxially received in the interior of the conveying tube. Under these circumstances, the diaphragm member forms a lining for the conveying tube. The control medium, preferably a hydraulic medium such as pressurized oil, is admitted into and withdrawn, at subatmospheric pressure, from the second compartment of the conveying tube, so that it acts on the diaphragm member and deflects the same either inwardly to reduce the volume of the first compartment, or outwardly toward the inner surface bounding the interior of the conveying tube to increase the volume of the first compartment to a maximum. When the diaphragm is tubular, its ends are overturned and connected to the ends of the guiding or conveying tube.

On the other hand, the conveying tube may also include two shell sections coextensive with one another in the longitudinal direction of the conveying tube, and means for connecting the shell sections to one another. Then, the diaphragm member may be clamped between the shell sections. Preferably, under these circumstances, the diaphragm member includes two diaphragm sections coextensive with one another in the longitudinal direction of the conveying tube and each having a pair of longitudinal marginal portions, the marginal portions of both of the diaphragm sections being clamped between the shell sections of the conveying tube. Each of the diaphragm sections may be of a strip-shaped configuration.

The diaphragm member or the sections thereof may be made of any suitable flexible material. The currently preferred flexible materials for the diaphragm member are Neoprene or other types of natural or synthetic rubber, as well as synthetic plastic material, such as vinylidene fluoride, hexafluoropropylene, as well as halogenated polyethylene.

The above-mentioned shell sections have respective clamping portions which are juxtaposed with one another and are provided with respective longitudinal recesses; then, the diaphragm sections may have respective bulges on their longitudinal marginal portions, which bulges are received in the respective longitudinal recesses of the clamping portions. The conveying tube has two longitudinally spaced end portions formed with respective circumferential recesses. Similarly, the diaphragm member has longitudinal ends and respective circumferential marginal portions thereat. Respective circumferential bulges are provided on such circumferential marginal portions, being received in the respective circumferential recesses of the conveying tube.

A further concept of the present invention resides in a method of introducing bulk material into a vessel, particularly combustible particulate material into a pressurized gasifying vessel, which comprises the steps of admitting the material into a confining space having a variable volume; pressurizing the contents of the confining space; discharging the pressurized contents into the vessel; reducing the volume of the confining space to complete the discharging step; and increasing the volume of the confining space preparatory to repetition of the above-mentioned steps.

The pressurizing step includes introducing a pressurized fluid into the confining space, such introduction being preferably continued during the discharging step to enhance the discharge of the material into the vessel. Preferably, the above-mentioned cycle of steps is also performed in connection with an additional confining space which is arranged in parallel with the above-mentioned confining space; then, the first-mentioned cycle and the second-mentioned cycle are shifted with respect to one another by a period of time amounting to one-half of the duration of each of such cycles. The pressurizing step may include introducing pressurized fluid discharged from the additional confining space during the reducing step into the confining space, and vice versa. The pressurized fluid can also be introduced into the confining space during the step of reducing the volume of the first compartment.

Another concept of the present invention resides in a method of operating an arrangement for introducing bulk material into a vessel, particularly combustible particulate material into a gasifying vessel, of the type having two conveying tubes arranged in parallel, a diaphragm member in each of the conveying tubes and subdividing the interior of the same into a first compartment communicating with a supply of the material and with the vessel, and a second compartment surrounding the first compartment and communicating with a source of control medium, first valves between the source and the first compartments, second valves between the first compartments and the vessel, a source of pressurized fluid communicating with the first compartments, third valves between the former and the latter, a conduit communicating the first compartments, and a fourth valve interposed in the conduit, wherein the method comprises the steps of withdrawing the control medium from the second compartment to increase the volume of the first compartment of one of the conveying tubes; opening the associated first valve to admit the material from the supply into the first compartment; closing the associated first valve; pressurizing the contents of the first compartment by admitting the pressurized fluid from the first compartment of the other conveying tube through the conduit and from the source of pressurized fluid; opening the associated second valve to discharge the pressurized contents of the first compartment into the vessel; continuing the admission of the pressurized fluid into the first compartment to enhance the discharge of the material into the vessel; simultaneously admitting the control fluid at elevated pressure into the associated second compartment to reduce the volume of the first compartment; closing the second valve; opening the fourth valve to admit the pressurized fluid from the first compartment into the first compartment of the other conveying tube.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DISCUSSION OF THE PREFERRED EMBODIMENT

Figure 1:
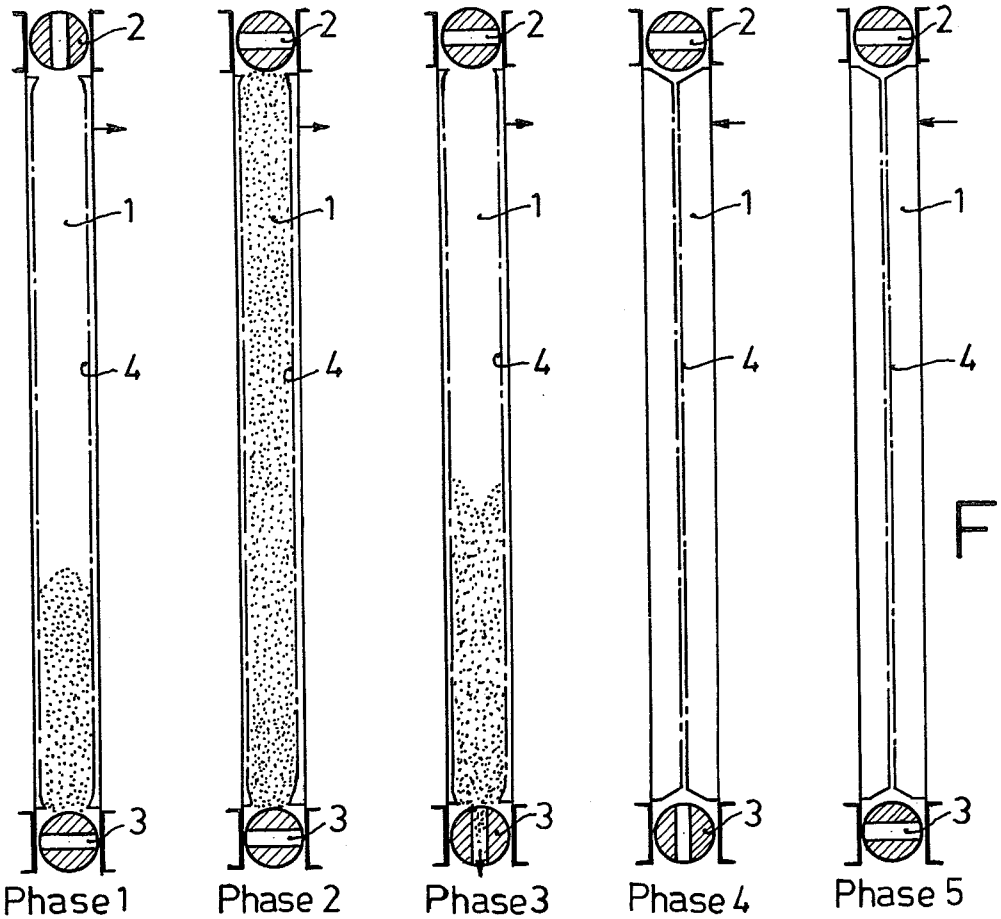
FIG. 1 is a diagrammatic illustration of one lock-type unit of the present invention during five different phases of operation.

Referring now to the drawing in detail, and first to FIG. 1 thereof, it may be seen that the arrangement of the present invention operates on the principle of a lock. It includes a conveying tube 1 which, at its upper end as illustrated in FIG. 1, carries a valve 2, such as a faucet-type rotating valve, while another valve 3 is located at the other, that is the lower, end of the conveying tube 1. The upper end of the tube 1 communicates with the supply of the material, and the lower end communicates with the gasifying vessel, as will be discussed in more detail later on. A flexible diaphragm member 4 is located in the interior of the conveying tube 1.

FIG. 1 illustrates the operation of the arrangement of the present invention during five different phases of the operating cycle. These different phases will now be briefly discussed.

Phase 1: The upper valve 2 is open and admits the material into the conveying tube 1, while the lower valve 3 is closed. Control medium, such as a hydraulic medium, is evacuated from the compartment surrounding the diaphragm member 4 so that the latter is pulled toward the inner surface of the conveying tube 1. Subatmospheric pressure thus develops in the internal compartment of the diaphragm member 4 and, due to the same and to the influence of gravity, the combustible particulate material of granular or dust consistency enters from a non-illustrated storage hopper into the interior of the conveying tube 1, and more particularly into the compartment externally bounded by the diaphragm member 4.

Phase 2: After the upper valve 2 has been closed, nitrogen originating in a different conveying tube which is not illustrated in FIG. 1 is introduced at elevated pressure into the central compartment of the conveying tube 1. To expel the nitrogen from the non-illustrated conveying tube, which is of the same construction as the illustrated conveying tube 1, hydraulic fluid acts on the diaphragm member of such other conveying tube in the radially inward direction so that the volume of the central space of such other guide tube which is bounded by the diaphragm member is reduced and the nitrogen present in such compartment is expelled. As a result of the transfer of the nitrogen, and of possible admission of additional nitrogen from a non-illustrated source, the pressure in the interior of the conveying tube 1 is gradually raised to the pressure which prevails in the non-illustrated gasifying arrangement or a distributing arrangement thereof.

Phase 3: When the lower valve 3 is opened, the combustible material falls from the interior of the conveying tube 1 into the non-illustrated distributing arrangement of the gasifying device.

Phase 4: The emptying of the compartment of the conveying tube 1 is supported by introducing additional quantities of nitrogen into such compartment. As the conveying tube 1 is gradually emptied, the diaphragm member 4 is gradually contracted by admitting hydraulic fluid into the compartment surrounding the diaphragm member 4.

Phase 5: After the closing of the lower valve 3, the nitrogen present in the interior of the conveying tube 1 is expelled into the non-illustrated other conveying tube, which has been filled with the combustible particulate material in the meantime. The filling and discharging operations of this other conveying tube are performed in the same fashion as described above; however, the operation of the non-illustrated conveying tube is phase-shifted with respect to the illustrated conveying tube 1 by one-half of the duration of the entire cycle of operation. When the phase 5 is finished, the filling and emptying operation can be repeated, beginning with the phase 1.

Figure 2:
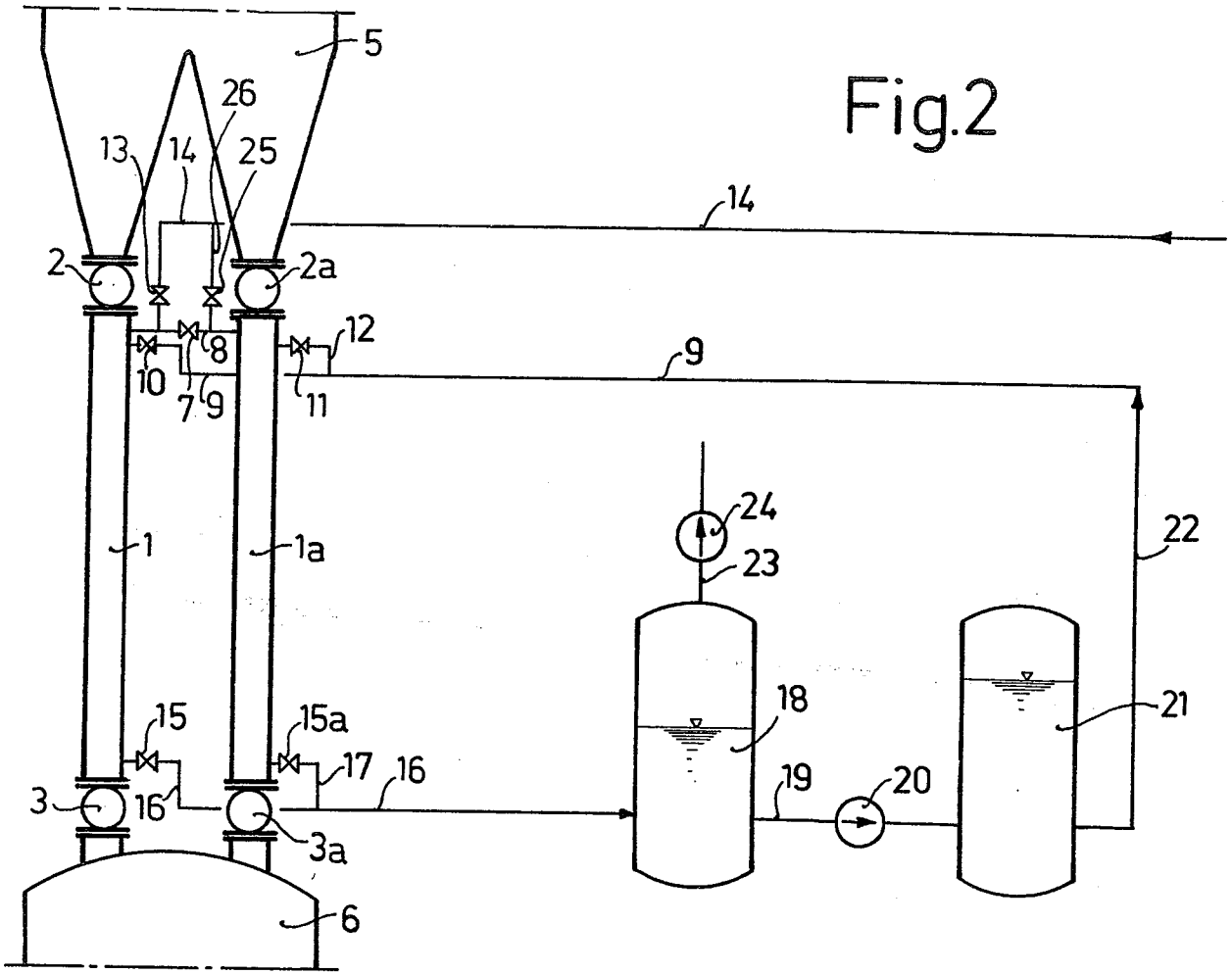
FIG. 2 is a somewhat simplified view of the arrangement of the present invention in the environment in which it is used, also illustrating auxiliary equipment.

FIG. 2 is a somewhat simplified view of the arrangement according to the present invention, in the environment in which it is used and together with auxiliary equipment used in connection therewith. It is to be mentioned in this connection that the gasifying arrangement proper has not been illustrated, in that the same is not needed for the explanation of the present invention and the present invention is not limited to use with one particular type of gasifying arrangement. Similarly, the present invention is not limited to the use of a predetermined operating pressure in the gasifying arrangement, so long as such pressure remains in the above-mentioned range of pressures, that is up to 6 atmospheres absolute.

FIG. 2 illustrates a supply hopper 5 which is at the atmospheric pressure. The above-discussed conveying tube 1, as well as the previously non-illustrated but discussed conveying tube 1*a* of the same construction as the conveying tube 1, are located underneath the hopper 5 in parallelism with one another, and the valve 2 as well as a valve 2*a* serve to establish and interrupt communication between the storage hopper 5 and the compartment bounded in the interior of the respective conveying tube 1, 1*a* by the respective diaphragm member. When the valve 2 is opened, combustible material having the consistency of a granulate or dust flows from the storage hopper 5 into the interior of the conveying tube 1. The reference numeral 6 designates a distributing arrangement of the gasifying device, and the lower valve 3 is capable of establishing and interrupting communication of the conveying tube 1 with such distributing arrangement 6. At the beginning of the operation, this valve 3 is closed. On the other hand, a valve 15 is open so that hydraulic medium can be withdrawn from the compartment surrounding the diaphragm member 4 through a conduit 16. Thus, the diaphragm member 4, which is not illustrated in FIG. 2, is expanded and pulled toward the inner surface of the conveying tube 1. Then, the upper valve 2 associated with the conveying tube 1, or a lower valve 3*a* associated with the conveying tube 1*a* and serving the same purpose as the valve 3, is closed. Another valve 7 is opened so that nitrogen expelled from the interior of the conveying tube 1*a* is advanced through a connecting circuit 8 and through the open valve 7 into the conveying tube 1*a*. To expel the nitrogen, first the valve 15 is closed and, simultaneously therewith, a valve 11 is opened so that hydraulic medium is admitted through a conduit 12 into the compartment surrounding the non-illustrated diaphragm member of the conveying tube 1*a*, thus reducing the volume of the compartment circumferentially bounded by such diaphragm member. After the valves 7 and 11 have been closed, and if needed, additional nitrogen can be fed into the interior of the conveying tube 1 through a conduit 14, after opening a valve 13 interposed therein.

Finally, the lower valve 3 is opened so that the combustible particulate material falls by gravity into the distributing arrangement 6 which is arranged underneath the conveying tube 1. Once in the distributing arrangement 6, the particulate material can be distributed or delivered by suitable conveyors, such as screw conveyors, to the non-illustrated gasifying arrangement.

Now, also the valve 2*a* is opened to thus establish connection between the supply hopper 5 and the interior of the conveying tube 1*a*. Simultaneously therewith, a valve 15*a* is opened and the hydraulic medium is drawn from the interior of the conveying tube 1*a* through conduits 16 and 17 and thus the non-illustrated diaphragm member is pulled toward the internal surface of the guide tube 1*a*. As a result of the increase in the volume of the central compartment of the conveying tube 1*a*, and due to gravity, the combustible particulate material falls from the supply hopper 5 into the interior of the conveying tube 1*a*. After the valve 2*a*, has been closed the valve 7 in the connecting conduit 8, as well as a valve 10, are opened so that hydraulic medium is admitted through a conduit 9 to the diaphragm member 4 in the conveying tube 1, and nitrogen is expelled from the interior of the conveying tube 1 and forwarded into the interior of the conveying tube 1*a*. When the valves 7 and 10 are closed, a valve 25 can be opened so that, if need be, additional nitrogen is admitted into the connecting conduit 8 from the conduit 14 via a branch conduit 26, and thus reaches the interior of the conveying tube 1*a*.

While, in the meantime, the valve 3 has been closed, the valve 3*a* is now opened so that the combustible material can flow from the conveying tube 1*a* into the distributing arrangement 6. This concludes the operating cycle, so that the same can be repeated in the above-discussed manner, by first opening the valve 2.

FIG. 2 also illustrates a low-pressure vessel 18 into which the hydraulic medium withdrawn through the conduits 16 and 17 is admitted. The necessary subatmospheric pressure is produced by a vacuum pump 24 which communicates with the low-pressure container 18 by a conduit 23. The hydraulic medium originally present in the low-pressure container 18 is delivered through a conduit 19 into a high pressure container 21. A pump 20 is interposed in the conduit 19 and compresses the medium in the high-pressure container 21 to the necessary level. The compressed hydraulic medium then flows from the high-pressure container 21, when needed, through a conduit 22 into the conduit 9 and from there into the two conveying tubes 1 and 1*a*. The needed nitrogen is delivered by an non-illustrated source of conventional construction into the conduit 14 at a pressure which corresponds to the operating pressure of the arrangement.

Figure 3:
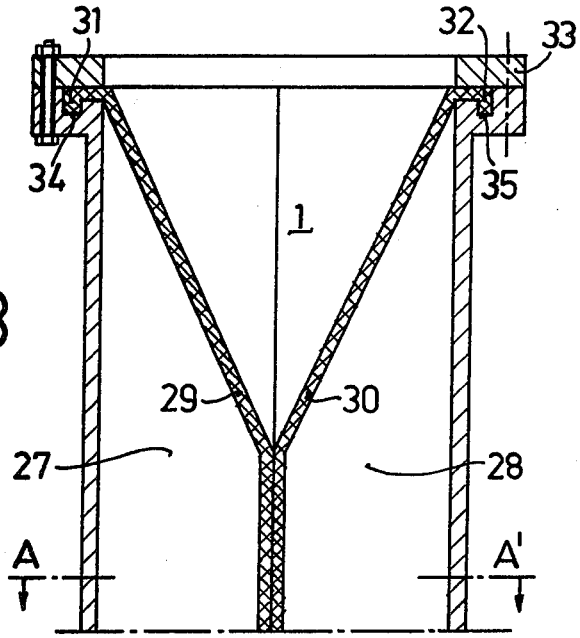
FIG. 3 is a longitudinal sectional view of an upper part of the arrangement according to the present invention.

FIG. 3 is a longitudinal sectional view of an upper portion of an exemplary embodiment of the conveying tube 1 of the present invention. In this embodiment, the conveying tube consists of two semi-tubular shell sections 27 and 28, and the diaphragm member 4 consists of two strip-shaped formations 29 and 30 which have longitudinal marginal portions that are clamped between the two shell sections 27 and 28. Of course, the two shell sections 27 and 28 are connected to one another in a suitable conventional way, such as by using screws or similar connecting elements.

This Figure also illustrates that the strip-shaped formations 29 and 30 are not only clamped between the two shell sections 27 and 28 at their longitudinal marginal portions, but that they are also pulled over the upper edge of the shell sections 27 and 28 at their terminal marginal portions, and connected thereto by a sealing ring 33. The strip-shaped formations 29 and 30, in order to improve the sealing properties thereof, are provided, at their upper edges, with bulges 31 and 32 which are received in corresponding recesses 34 and 35 of the upper edges of the two shell sections 27 and 28. Similar arrangements are also provided at the lower end of the conveying tube 1. When, in the position illustrated in FIG. 3, hydraulic medium acts from radially outwards on the diaphragm member 4, and the central compartment is devoid of any particulate material, the two strip-shaped formations 29 and 30 can tightly press against one another in the central region of the guide tube 1, while forming generally funnel-shaped openings at each of the upper and lower ends of the conveying tube 1.

Figure 4:
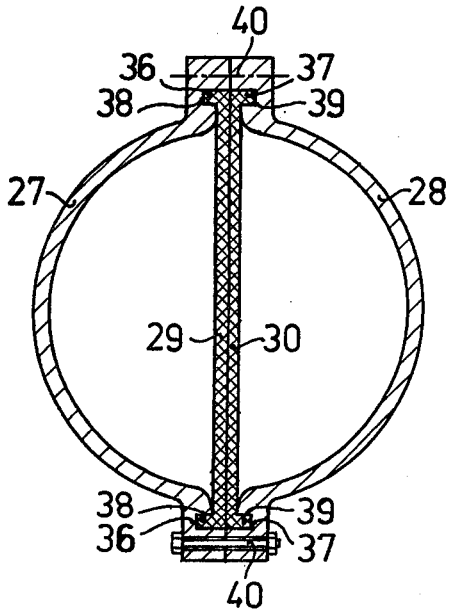
FIG. 4 is a cross-sectional view taken on line A—A' of FIG. 3.

FIG. 4 illustrates a cross-sectional view through the conveying tube 1 taken on line A—A′ of FIG. 3. Here again, the two shell sections 27 and 28, as well as the two strip-shaped formations 29 and 30, can be seen, the latter formations forming the diaphragm member 4. The formations 29 and 30 have longitudinal marginal portions which are formed with bulges 36 and 37 which are received in corresponding longitudinal recesses 38 and 39 provided in the clamping portions of the two shell sections 27 and 28. Connecting screws 40 connect the two shell sections 27 and 28 to one another and, upon tightening, the connecting screws 40 provide for impermeable sealing action along the clamping portions of the shell sections 27 and 28.

However, the diaphragm member 4 can also be of one piece and of a tubular configuration, and even under these circumstances it may be clamped between the clamping portions of the shell sections 27 and 28. However, it can also be loosely received in the interior of the conveying tube 1, whether the same is circumferentially complete or consists of two or more shell sections. Even under these circumstances, the upper marginal portion and the lower marginal portion of the diaphragm member 4 can be connected to the upper portion of the conveying tube 1 and to the lower portion of the conveying tube 1, respectively, in the same manner as has been discussed above in connection with FIG. 3.

EXAMPLE 8 metric tons per hour of coal dust are to be delivered to the gasifying device. Inasmuch as the coal dust has a specific weight of 0.75 metric tons per cubic meter, the volume taken up by the amount of coal dust which is to be delivered in an hour is 10.7 cubic meters. The two conveying tubes 1 and 1*a* which are to be used under these circumstances have an inner diameter of 0.3 meters and a length of 2 meters each. Thus, the maximum volume of each of the conveying tubes 1 or 1*a* is 0.14 cubic meter and, since there are two conveying tubes 1 and 1*a*, thirty-eight full cycles have to be performed per hour by each of the conveying tubes 1 and 1*a*. This means that the period of one cycle amounts to approximately 1.5 minutes.

It will be understood that each of the elements described above, or two or more together, may also find a useful application in other types of constructions differing from the types described above.

While the invention has been illustrated and described as embodied in an arrangement for and a method of introducing combustible particulate material into a pressurized gasifying vessel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of operating an arrangement for introducing bulk material into a vessel, particularly combustible particulate material into a gasifying vessel, of the type having two conveying tubes arranged in parallel, a diaphragm member in each of the conveying tubes and subdividing the interior of the same into a first compartment communicating with a supply of the material and with the vessel, and a second compartment surrounding said first compartment and communicating with a source of control medium, first valves between the supply and the first compartments, second valves between the first compartments and the vessel, a source of pressurized fluid communicating with the first compartments, third valves between the source of presurized fluid and the first compartments, a conduit communicating the first compartments, and a fourth valve interposed in the conduit, the method comprising the steps of withdrawing the control medium to increase the volume of the first compartment of one of the conveying tubes; opening the associated first valve to admit the material from said supply into said first compartment; closing said associated first valve; equalizing the pressure in said first compartment with that in the vessel by opening said third and fourth valves thus admitting the pressurized fluid from said first compartment of the other conveying tube through said conduit and from said source of pressurized fluid; closing said fourth valve opening the associated second valve to discharge the pressurized contents of said first compartment into the vessel; continuing said admission of the pressurized fluid from said source into said first compartment to enhance the discharge of the material into the vessel; simultaneously forcing the control fluid at elevated pressure into the associated second compartment to reduce the volume of said first compartment; closing said second valve; opening said fourth valve during said forcing step to admit the pressurized fluid from said first compartment into the first compartment of the other conveying tube; closing said fourth valve prior to the opening of said first valve; and subsequently increasing the volume of said first compartment of the one conveying tube.

2. A method as defined in claim 1, wherein said steps constitute a cycle and an additional cycle of the same steps is performed in connection with the other first compartment; and wherein said cycle and additional cycle are offset with respect to one another by a period of time amounting to one-half of the duration of each of such cycles.

3. A method of introducing bulk material into a pressurized vessel, particularly combustible particulate material into a gasifying vessel, comprising the steps of communicating a discharge end of a confining space having a variable volume with the vessel; interrupting the communication of the discharge end with the vessel; opening an inlet end of the confining space; admitting the material into the confining space through the open inlet end thereof; closing the inlet end of the confining space; introducing a pressurized fluid into the confining space to thereby equalize the pressure therein with that in the vessel; discharging the pressurized contents of the confining space into the vessel, including restoring the communication of the discharge end of the confining space with the vessel, and reducing the volume of the confining space subsequent to said closing step to thereby enhance the discharge of the contents through the discharge end subsequent to said restoring step; and increasing the volume of the confining space preparatory to repetition of the above-mentioned steps.

4. A method as defined in claim 3 and further comprising the step of continuing said introducing step during said discharging step for the fluid to enhance the discharge of the material into the vessel.

5. A method as defined in claim 3, wherein said steps constitute a cycle; further comprising an additional cycle of the same steps performed in connection with an additional confining space also having a variable volume; and wherein said cycle and additional cycle are offset with respect to one another by a period of time amounting to one-half of the duration of each of such cycles.

6. A method as defined in claim 5, wherein said introducing step includes conveying pressurized fluid discharged from one of said confining spaces during said reducing step into the other confining space.

7. A method as defined in claim 3; and further comprising the step of introducing a pressurized fluid into said confining space during said reducing step.

8. An arrangement for introducing combustible particulate materials into a pressurized gasifying vessel, comprising a material supply; at least one elongated conveying tube; at least one flexible diaphragm member extending longitudinally of said conveying tube in the interior thereof and subdividing the latter into a first compartment having an inlet end communicating with said supply and an outlet end adapted to communicate with the vessel, and an enclosed second compartment situated between said diaphragm member and said conveying tube and surrounding said first compartment; first valve means arranged at said inlet end and displaceable between an open position in which the material is admitted into said first compartment and a closed position; second valve means arranged at said outlet end and displaceable between a discharging position in which the material is discharged from said outlet end and a closed position; means for admitting a control medium into said second compartment to inwardly deflect said diaphragm member and thereby enhance the discharge of the material from said first compartment into the vessel when said first valve means is in said closed position and said second valve means in said discharging position; and means for equalizing the pressure in said first compartment with that in the vessel, including means for introducing a pressurized fluid into said first compartment at least when both said first and said second valve means are in their respective closed positions.

9. An arrangement as defined in claim 8, wherein said conveying tube, diaphragm member, first and second valve means, and admitting means constitute an introducing unit; further comprising at least one additional introducing unit identical with and extending in parallelism with said introducing unit and adapted to be filled with and emptied of the material in alternation with said introducing unit.

10. An arrangement as defined in claim 9; and further comprising means for introducing a pressurized fluid into said first compartments of the respective one of said introducing unit and additional introducing unit upon closing of the first valve means thereof to equalize the pressure in the respective first compartment with that in the vessel.

11. An arrangement as defined in claim 10, wherein said introducing means includes conduit means communicating said first compartments of said units with one another, and third valve means interposed in said conduit means and operative for establishing communication between an empty first compartment and a full first compartment so that, upon contraction of said diaphragm member bounding said empty first compartment by said admitting means, said pressurized fluid flows through said conduit means into said full first compartment.

12. An arrangement as defined in claim 10, wherein said introducing means includes a source of the pressurized fluid, duct means communicating said source with said first compartments, and additional valve means interposed in said duct means and operative for establishing and interrupting communication between said source and said first compartments.

13. An arrangement as defined in claim 8, wherein said diaphragm member has a tubular configuration and is coaxially received in said interior of said conveying tube.

14. An arrangement as defined in claim 8, wherein said conveying tube includes two tube sections coextensive with one another in the longitudinal direction of said conveying tube, and means for connecting said tube sections to one another; and wherein said diaphragm member is clamped between said tube sections.

15. An arrangement as defined in claim 14, wherein said diaphragm member includes two diaphragm sections coextensive with one another in the longitudinal direction of said conveying tube and each having a pair of longitudinal marginal portions; and wherein said marginal portions of both of said diaphragm sections are clamped between said tube sections of said conveying tube.

16. An arrangement as defined in claim 15, wherein each of said diaphragm sections is of a strip-shaped configuration.

17. An arrangement as defined in claim 15, wherein said tube sections have respective clamping portions juxtaposed with one another and provided with respective longitudinal recesses; and wherein said diaphragm sections have respective bulges on said longitudinal marginal portions thereof, which are received in said respective longitudinal recesses of said clamping portions.

18. An arrangement as defined in claim 8, wherein said conveying tube has two longitudinally spaced end portions having respective circumferential recesses; and wherein said diaphragm member has circumferential marginal portions at the respective longitudinal ends thereof, and respective circumferential bulges on said circumferential marginal portions, which are received in said respective circumferential recesses of said conveying tube.

* * * * *